United States Patent [19]

Lemmons

[11] Patent Number: 4,826,018

[45] Date of Patent: May 2, 1989

[54] MINERAL FINES SEPARATION MACHINE

[76] Inventor: Norvel Lemmons, Rte. 4, Box 246, Pine Bluff, Ark. 71602

[21] Appl. No.: 189,474

[22] Filed: May 2, 1988

[51] Int. Cl.[4] ..... B03B 5/08

[52] U.S. Cl. ..... 209/433; 209/430; 209/506; 209/498

[58] Field of Search ..... 209/428, 430, 431, 433, 209/470, 485, 498, 506

[56] References Cited

U.S. PATENT DOCUMENTS

| | | | |
|---|---|---|---|
| 932,691 | 8/1909 | Evans et al. | 209/433 |
| 1,030,427 | 6/1912 | Pinder | 209/433 |
| 1,116,092 | 11/1914 | McIntire | 209/506 X |
| 2,047,773 | 7/1936 | Greene et al. | 209/431 |
| 4,352,733 | 10/1982 | Hibbard | 209/430 |

*Primary Examiner*—Johnny D. Cherry
*Assistant Examiner*—Gary C. Hoge
*Attorney, Agent, or Firm*—Stephen D. Carver

[57] ABSTRACT

A mineral slurry processing machine for recovering gold from raw fines. An elongated, rigid skid supports a frame plate coupled thereto by vibration transmitting bearings. An inclined processing ramp is adjustably mounted to the plate. An endless belt entrained over the ramp for continual rotation is equipped with a specially grooved working surface which helps separate gold from the slurry. A plurality of similar, regularly spaced apart grooves are cut into the exposed working surface of the belt, and the angulated configuration of the grooves facilitates particle separation and recovery. The belt is divided into a fine receiving region and an adjacent gold conveying region. Each groove includes a first segment which is "angled" with respect to the direction of travel of the belt, and a second segment which is substantially perpendicular to the direction of travel of the belt. Separate fine receiving and gold conveying regions thus exist. An elongated divider plate disposed above the belt isolates the separate fine receiving and gold conveying regions. The ramp receives preclassified fines which are dropped upon the continually moving belt through a distributor plate. Desired gold particles are collected on the belt within the grooves. A slurry output of unwanted barren waste results at the lower end of the ramp. The concentrated gold bearing fine is conveyed to the upper portion of the ramp, where it is extracted from the belt and accumulated in a suitable hopper. During operation the ramp is vigorously shaken by an associated vibrator system. The concentrated slurry produced by the machine is economically suitable for purification by conventional laboratory techniques.

18 Claims, 4 Drawing Sheets

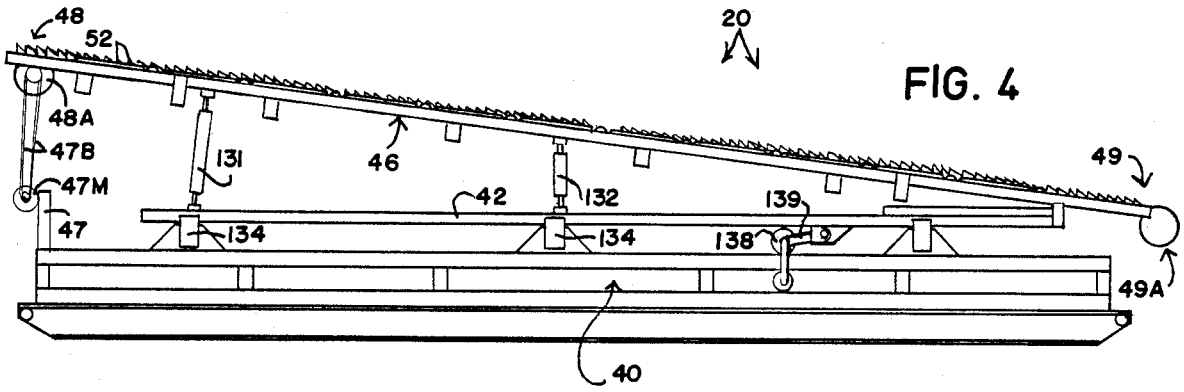
FIG. 4
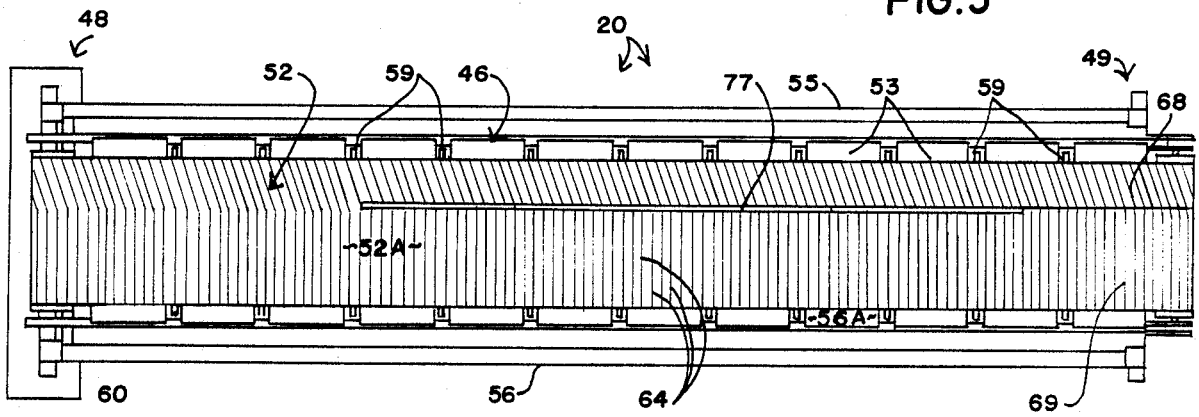
FIG.5
FIG. 6
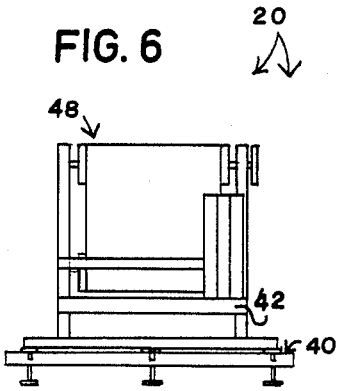
FIG. 7
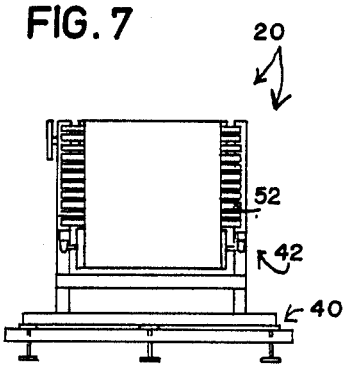

FIG. 8
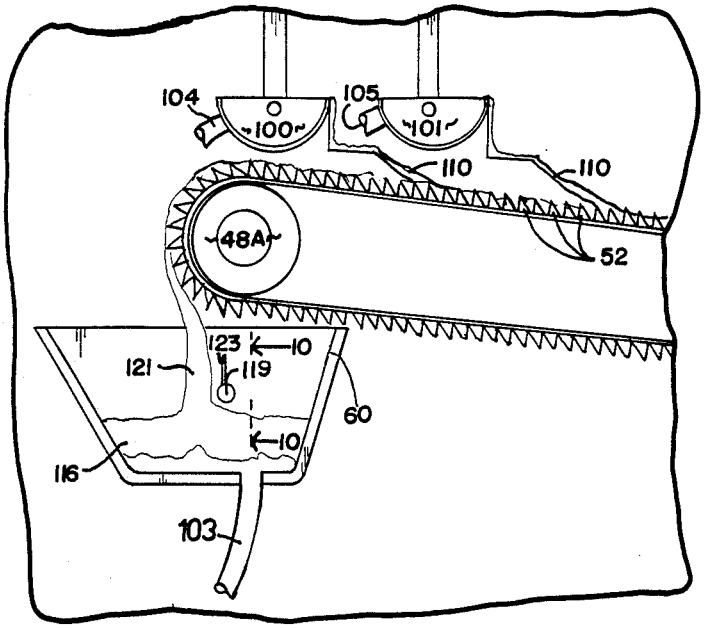
FIG. 9
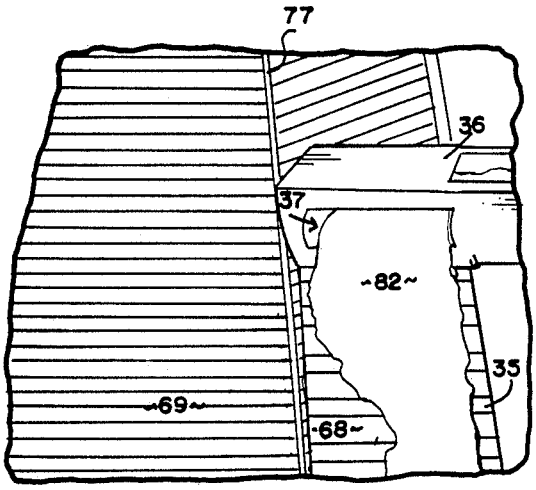
FIG. 10
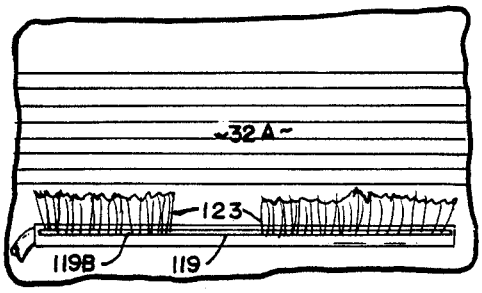
FIG. 12
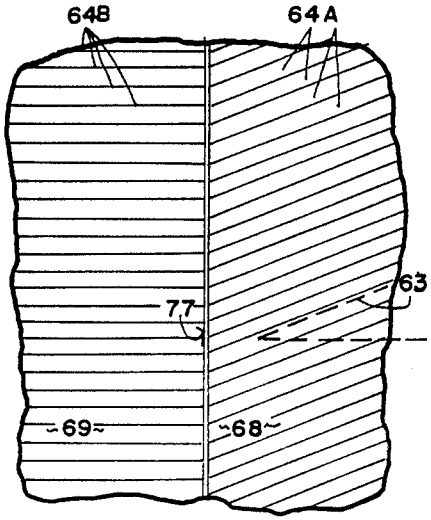
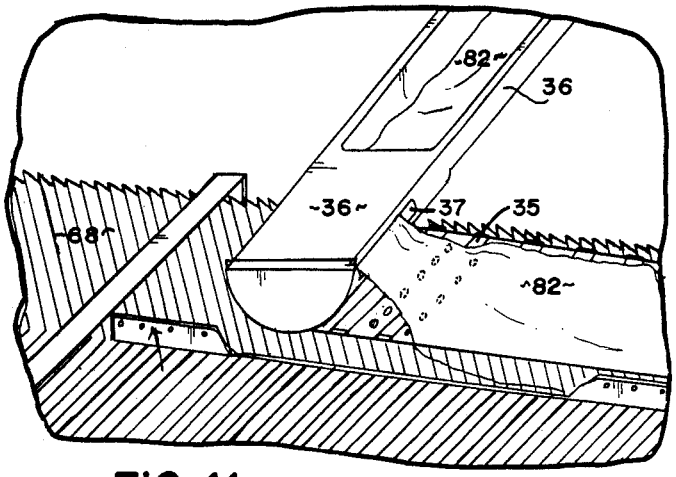
FIG. 11

MINERAL FINES SEPARATION MACHINE

BACKGROUND OF THE INVENTION

The present invention relates generally to mining technology and machinery in which metals are recovered from ore bearing sands. More particularly, the present invention relates to a mineral extraction machine adapted to recover fine gold particles from raw ore slurries preclassified by size.

In the prior art is it well known to provide some form of separation apparatus wherein materials of specific gravities are separated from one another through the use of conveyers, water or the like. The use of water for slurry processing is well known in the mineral extraction and processing arts. Water is often used as the medium for providing a slurry, which can thereafter be processed though filters, settling equipment, or the like. A wide variety of filters are known in the art for separating particles of different sizes from a slurry. Foraminous conveyers or drums are employed as filters for use in the de-rocking process where incoming fines are first processed. One known de-rocking apparatus of which I am familiar is the trommel. It employs a rotating, foraminous drum which constrains unwanted aggregates while passing fines of a desired size range.

Very fine deposits of gold are accumulated within the banks of certain northern rivers, such as the Liard river in the Yukon Territory, Canada. Particles of gold are carried through river water and deposited into sand banks along the river's edge, intermingled with fine river sands, silt, aggregates, and numerous particles of other unwanted contaminants. Typically the fines to be processed are a combination of silicon sand, gravel, and rocks to about twenty inches in diameter. Mixed with this are deposits of magnetite and particles of gold, silver, and platinum ranging in size from 30 to approximately 250 microns. Economically worthwhile processing has up until now been difficult. As will be appreciated by those experienced in the art of gold-fines processing, the task of obtaining a satisfactory yield of gold aggregate from a river deposit may be an extremely difficult and expensive one.

Conventional machines for fine separation which have been employed for the purposes of concentrating fine gold deposits include trombles, or rotary drum-type de-rockers, Rackard spirals which employ gravity and centrifugal force to separate heavier particles from a fine slurry, and shaker tables, such as the Gemni-brand table. Various forms of inclined sluices have been employed in the mineral recovery arts, in conjunction with one or more inputs and outputs of water. Water is often used as a separating medium because it inherently enables minerals of different specific gravities to be separated. In addition, it is known to convey and process mineral ores in a water solution. However, none of these systems taken alone have the ability to process a large enough volume of raw material to make ground paying less than ten dollars of gold per yard commercially feasible. Making a profit with aggregate paying as little as two dollars per yard is especially important in the gold fields of the far north where the mining season is only three or four months per year. Unto the present day when known systems are employed conventionally in various combinations, commercially worthwhile fine gold recovery has not been very successful.

A wide variety of systems used for different types of gold mining operations are known in the prior art. For example, U.S. Pat. No. 2,491,912, issued to M. Walker on Dec. 20, 1949 disclosures an inclined, sluice-like separating apparatus wherein a pair of spaced-apart, inclined troughs in which rotatable conveyers are disposed circulate and move materials to be separated. A drainage screen having a plurality of graduated slots enables materials to be separated through registry in the appropriate slots.

The gravel washer of U.S. Pat. No. 3,682,299 issued to Conley, Aug. 8, 1972, includes an upwardly inclined, foraminous conveyer belt which moves gravel between a lower position within water and an upper position at a discharge end. The invention seeks to remove trash from gravel without sluicing. U.S. Pat. No. 4,298,232 issued Nov. 3, 1981, provides apparatus for continuous mining wherein conveyers are employed in conjunction with the mining of coal.

U.S. Pat. No. 2,698,087 issued Dec. 28, 1954 to Call, discloses a flotation and separation tank which separates potatoes from the stones and detritus which are generally recovered during harvesting by conventional digging machines. Flow streams of water are employed within a hopper in conjunction with the rotation of foraminous belts. Water currents separate the potatoes from the unwanted materials, and both the potatoes and the contaminants are removed from the hopper by conveyers.

With respect to all known prior art, I am unaware of any machine which can properly filter gold particles or accumulations from river bank sands. I am unaware of any prior art system which can appropriately and economically filter the fines recovered from such river bank to concentrate and recover usable gold deposits.

SUMMARY OF THE INVENTION

The present invention comprises a mineral separating machine which processes mineral slurry and recovers heavy metal ores such as gold. The machine contemplates a system for accumulating raw sands or deposits, and for thereafter prefiltering or at least de-rocking the deposits to be processed.

The machine preferably comprises an elongated ramp which is firmly constrained by an elongated rigid, skid assembly. The skid is adapted to be disposed upon an appropriate supporting surface, and it supports an intermediate frame plate coupled thereto by vibration transmitting bearings. This plate secures the ramp at a predetermined, adjustable angle. The ramp includes spaced-apart upper and lower ends, each terminating in suitable roller apparatus, and an elongated belt is entrained about the rollers for continual rotation. A suitable motor coupled to appropriate gears and chains drives the belt so that its outer uppermost surface moves from the lower end of the ramp to the upper end to process the slurry deposited upon it.

The ramp receives prefiltered or derocked fines from an appropriate trough or conveyer, which outputs upon an inclined distribution plate which distributes and spreads the slurry about the belt below. A flow of water down the belt is previously established by spaced apart water injectors disposed at the top of the ramp. A plurality of similar, regularly spaced apart grooves are cut into the exposed working surface of the belt, and the angulated configuration of the grooves enhances particle separation. The entire width of the belt is thus divided into two adjacent functional regions, one for receiving raw fines, and one for conveying recovered gold particles. Each groove includes a first segment which is "angled" with respect to the direction of travel of the belt, and a second segment which is substantially perpendicular to the direction of travel of the belt. A plurality of groove segments thus collectively define separate fine receiving and gold conveying regions upon the belt surface.

Preferably an elongated, planar, divider plate is functionally disposed above the belt over the groove apexes. This generally perpendicularly oriented baffle helps define and separate the separate fine receiving and gold conveying regions upon the belt. The raw slurry to be thereafter processed by the machine is outputted through the distributor plate and dropped upon the belt fine receiving region adjacent the divider plate. The slurry tends to drop by gravity down the belt. When it first flows over and gently contacts the angulated portions of the grooves, it mixes with the flow of water originating at the top of the ramp. However, a separation effect is achieved, since heavier metallic gold particles tend to move towards the conveying side of the grooves, having gathered momentum by their travel along the angled groove portions.

The heavier particles in the aggregate tend to move toward the conveying side of the belt being propelled by the flow of water down the belt. While traveling down the angled groove portions, these heavier particles are rolled in a fashion so the lighter portion of the heavier particles will separate and be carried away with the waste by water flow. The heavier fine gold particles tend to accumulate in the calmer water of the belt conveying region and are drawn upward trapped in the groove sections of the belt. The vibration of the upper frame (and belt) and the flow of clean water down the conveying region continue to eliminate unwanted lighter particles as the gold bearing concentrate is raised to the top of the incline.

A slurry output of unwanted contaminants is extracted from the machine at the lower end of the ramp. Similarly, a concentrated gold bearing fine is conveyed by the belt grooves to the upper portion of the ramp, where it is extracted from the belt and accumulated in a suitable hopper. Preferably a belt cleaning and washing spray system is employed in association with the hopper at the top of the ramp to aid in the extraction process. One acceptable mode is for the ramp slurry to be serially processed through a Rackard spiral and then a Gemni shaker table, and thereafter the mixture is ideally processed by any suitable laboratory method. My experiments have revealed, then, that the spiral is usually unnecessary, but that some form of shaker table is usually required.

In combination with the slurry filtering accomplished by the belt and its associated grooves, the ramp is preferably vigorously shaken by an associated vibrator system. To this effect a motor driven vibrator assembly is coupled to the frame skid, and the frame support plate is coupled through unique motion-transmitting bearings to the skid. For optimum performance the rate of vibration, slurry and water flow rates, and the ramp operation angle can be adjusted as necessary.

Thus a fundamental object of the present invention is to provide a mineral fine separation system adapted to liberate a concentrated mineral ore fine from a rough mineral fine.

A similar object of the present invention is to provide a mineral separation system of the character described, which concentrates gold or other heavy metal metallic ores and which is capable of processing rough fines outputted by conventional de-rocking trommels and the like.

Another basic object of the present invention is to recover gold from alluvial sand deposits.

Yet another object of the present invention is to provide a mineral separation system of the character described which will produce large volumes of mineral ore fines in relatively short periods of time.

A still further object of the present invention is to provide a ramp mounted, belt-driven system for separating metallic ores from within a tumbling, water propelled pathway.

With respect to environmental control regulations, it is desirable to provide a slurry separation machine of the character described which can readily route "wastes" to appropriate areas for proper storage and settling.

Yet another object is to provide a gold recovery system which will open vast amounts of gold-bearing properties paying less than $10.00 per yard of fine gold to successful mining that have hereto been considered too marginal for commercial mining.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 4 is an enlarged, fragmentary, side elevational view of the preferred ramp assembly, further illustrating the preferred skid and vibrating plate structure;

FIG. 5 is a top plan view of the apparatus of FIG. 4, with portions thereof omitted for clarity;

FIG. 6 is a left side elevational view taken from an observation point generally to the left of FIG. 5, with portions thereof omitted for clarity;

FIG. 7 is a right side, elevational view taken from an observation point generally to the right of FIG. 5, with portions thereof omitted for clarity;

FIG. 8 is an enlarged, fragmentary sectional view illustrating the upper end of the ramp assembly and the fine recovery hopper;

FIG. 9 is an enlarged, fragmentary isometric view of the slurry injection mouth region of the chute and input region of the ramp assembly;

FIG. 10 is an enlarged, fragmentary sectional view illustrating the interior of the recovery hopper, taken from a position generally corresponding to line 10—10 in FIG. 8 looking in the direction of the arrow, with portions thereof omitted for clarity;

FIG. 11 is an oblique, fragmentary diagrammatic view of the belt showing the slurry feed upon the working surface of the preferred belt; and, FIG. 12 is an enlarged top plan view showing the first and second interconnected portions of the cooperating grooves defined in the belt.

DETAILED DESCRIPTION

Figure 1:
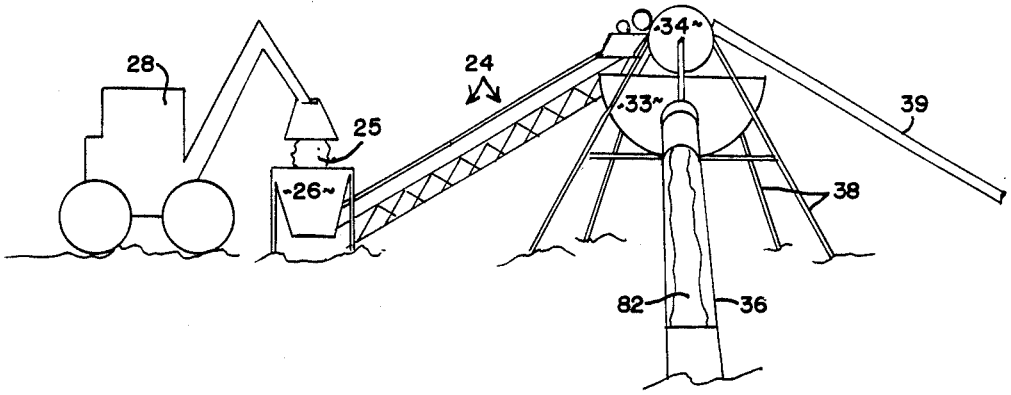
FIG. 1 is a fragmentary pictorial view of a typical work area in which the present invention may be employed, illustrating a preferred raw ore processing and delivery trommel system which feeds a de-rocked slurry to the instant system.
Figure 2:
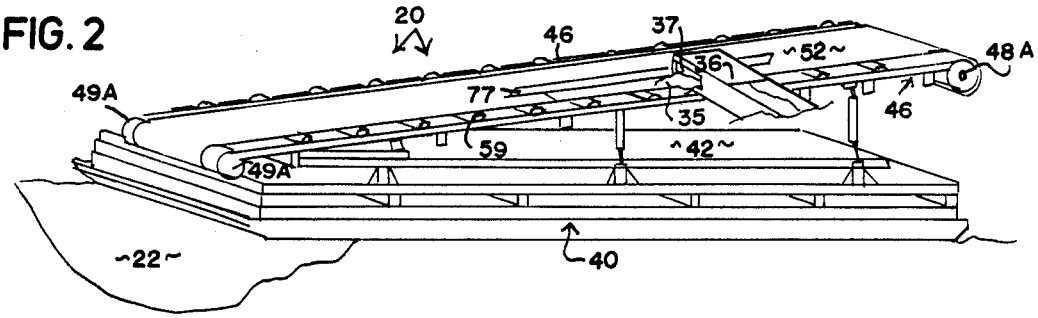
FIG. 2 is a fragmentary isometric view of the separation machine of the present invention, with portions thereof omitted or shown in section for clarity.
Figure 3:
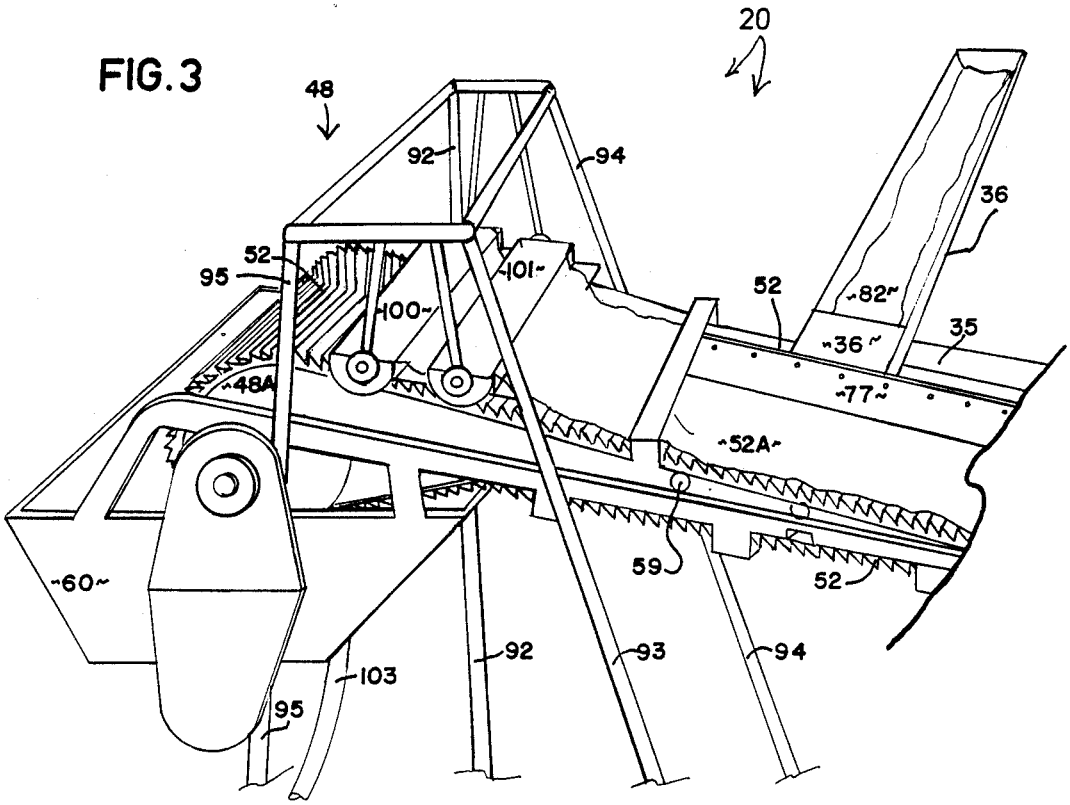
FIG. 3 is an enlarged, fragmentary, isometric view illustrating the upper end of the preferred ramp assembly.
Figure 4B:
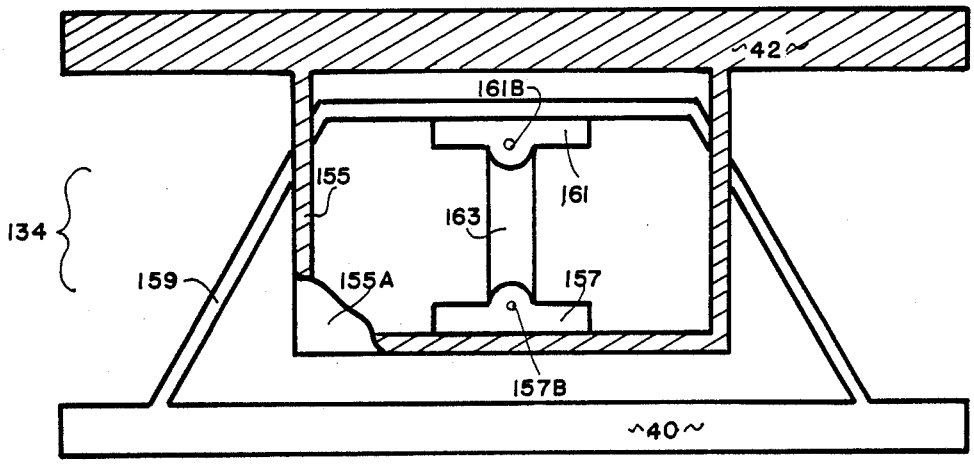
FIG. 4B is a greatly enlarged, fragmentary, sectional view of the preferred bearing assembly employed to suspend the ramp relative to the lower skid.

With initial reference now directed to FIGS. 1 and 2 of the appended drawings, the mineral fines separation machine of the present invention has been generally designated by the reference numeral 20. Machine 20 is adapted to be erected and operated upon a generally flat supporting surface such as ground surface 22, adjacent the fine processing station generally designated by the reference numeral 24. It is adapted to receive a slurry comprised of sands, mineral ore deposits, bank gravel and the like. Larger aggregate constituents of the slurry actually delivered to machine 20 will have been removed by the conventional fine-processing apparatus 24.

Fine classification contemplates the initial accumulation of raw mineral bearing aggregate 25 within a suitable hopper 26 through a conventional motorized front-end loader 28. Gold bearing aggregate is gathered from a river bank, and it is transmitted at a constant rate by feeder hopper 26 onto a conventional conveyer feeding the conventional de-rocker trommel assembly 34. Classified fines are collected in a vat 33 and conveyed to the instant machine 20 via gravity flow through chute 36. A conventional rotary trommel 34 (FIG. 1), preferably a 3/16's machine, is supported over ground 22 by conventional feet 38, and it employs a water input pipe 39 to provide slurry mixing. A suitable over-the-counter trommel assembly may be purchased from Harvey's Welding Service in Fairbanks, Ak. The preferred trommel output is characterized by particles of a diameter generally no greater than three sixteenths of an inch.

Chute 36 transmits a de-rocked slurry 82 suitable for further mineral classification to the fine separation machine 20 (FIG. 2). The chute is preferably at least thirty feet in length to encourage a capillary effect in the chute bottom, providing time for the heavier slurry constituents to separate from the water and drop to the chute bottom. This chute is slightly acutely oriented relative to ground approximately five degrees. Its preferred angular slope helps separate the slurry by establishing a flow rate and length sufficient to allow turbulent slurry to settle somewhat. Chute output is received via a horizontal distribution plate assembly, generally designated by the reference numeral 35. Assembly 35 receives slurry from the slot-like output mouth 37 of the chute, and distributes it upon the ramp. Assembly 35 passes the slurry over a planar, foraminous surface 35B which allows slurry to drop through below to the rotating belt over a wide portion of its area, since flowing slurry drops through the dispersed holes in the surface 35B, and slurry is thus widely distributed over the surface of the lower, moving belt.

With additional reference directed now to FIGS. 2 through 11 of the drawings, the machine 20 comprises a skid structure generally designated by the reference numeral 40 which is adapted to be disposed directly upon the supportive ground surface 22, and which supports a rigid, intermediate frame plate 42. Plate 42 mounts the ramp assembly 46. In the best mode the ramp assembly is approximately eight feet tall at its upper end, and the lowermost end is approximately three feet high, depending upon the selected angle. The best operating angle seems to be around ten to twenty five degrees, with fifteen degrees being optimum for Yukon river bank gravel. The preferred angle of ramp operation depends on the aggregate-sandy soil may require a fifteen degree orientation, while heavy clay and silt soil may necessitate as much as a twenty five degree slant. Siltier sand (i.e. with increased clay deposits) will generally require an increased ramp operating angle.

Ramp assembly 46 includes an upper end generally designated by the reference numeral 48 and a spaced apart lower end generally designated by the reference numeral 49. Each of these ends is provided with a suitable roller assembly 48A and 49A respectively over which a continuous outwardly toothed belt 52 is entrained for rotation. As best viewed in FIGS. 4 and 5, the ramp structure 46 includes a pair of rigid, elongated parallel sides 55 and 56 between which extend a plurality of conventional rollers 59 for supporting the endless belt 52. A plurality of rigid, flat skid plates 53 extend between the ramp sides and between alternate rollers. These skid plates provide a support surface for the underside of the belt 52. Preferably belt 52 is made of two-ply rubber material, 3/16-inch top, 1/16th-inch bottom. The belt is rotated by a conventional electric motor 47M (FIG. 4) mounted near hopper 60 (FIG. 3) which rotates drive roller 48A to continuously rotate the belt. As belt rotation occurs, the working surface 52A of the belt will continuously travel up the ramp 46. Contemporaneously slurry and water will be dumped on the belt and will tend to fall down the ramp.

With reference now primarily directed to FIGS. 5 and 9–11, the outermost surface 52A of belt 52 presents a "working" surface which is dynamically moved over and around the ramp 46. This surface is subjected to a flow of water established at the ramp top, and it receives the mineral slurry to be processed. A plurality of identical, somewhat V-shaped grooves 64 are defined upon the belt on outer operative surface 52A.

Each of these generally parallel, spaced apart grooves comprises separate first and second cooperating segments 64A and 64B. Segments 64A form an acute angle 63 (FIG. 12) relative to the direction of travel of the belt 52. Angle 63 is preferably from fifteen to twenty-five degrees, and in the best mode known to me it is twenty degrees. The grooves are preferably one-eighth inch deep, they are spaced one half inch apart, and the flat spot between adjacent grooves is approximately 3/16 inches in length. The cooperating second groove segments 64B intersect groove segments 64A, and they are approximately twice as long. As best viewed in FIG. 5, the belt working surface 52A is thus divided into two separate sections, consisting of a relatively narrow feed region 68 and an adjacent, wider mineral recovery region 69. As explained below, these regions are preferably physically separated by a rigid, baffle-like divider plate 77.

Incoming de-rocked slurry outputted from trommel 34 (FIG. 1) arrives via conveyer 36 for output through mouth 37 onto the distribution plate, from which it is spread upon belt feed region 68. As best viewed in FIGS. 5, 2 and 12, the flat, elongated divider plate 77 extends vertically along and slightly above the ramp a substantial portion of the ramp's length. The baffle starts immediately adjacent the horizontal distribution plate 35 (FIG. 9) so that incoming slurry 82 (FIGS. 9, 11) is confined to belt feed region 68. Because of plate 77, slurry will be discouraged from spilling over onto adjacent belt recovery region 69 as it is outputted upon the ramp and later flows toward the lower end 49 thereof. A holding pond, not shown, will eventually receive water, unwanted minerals and floating matter which will flow down the ramp during operation. However, desired gold particles will be accumulated in the form of a fine of substantially higher concentration, which will be conveyed upwardly for subsequent recovery adjacent upper ramp end 48 by belt section 69.

With additional reference directed now to FIG. 4, the upper ramp end roller 48A is driven by belt 47B and motor 47M. The motor is mounted on a slotted stanchion 47 welded to the skid assembly. The ramp is supported by central turnbuckles 131 and 132 which can be adjusted in length to effectuate a desired angle of operation. They extend between suitable connections at the bottom of the ramp and the frame member 42. Stanchion 47 is slotted so that motor 47M can be secured in an appropriate place depending upon selected ramp angle (alternatively the drive belt 47B could be changed) to accommodate different ramp angles and the concomitant varying height of the ramp end 48.

The frame plate 42 is in turn suspended above the skid structure 40 by unique bearing assemblies 134 (FIGS. 4 and 4B) which facilitate transmission of vibration from plate 42 to the ramp structure. In the best mode the bearing structure is assembled as in FIG. 4B. Assemblies 134 are comprised of generally U-shaped downwardly projecting brackets 155 welded at the underside of plate 42. These brackets 155 include a shroud portion 155A (FIG. 4), and they support an internal pillow block 157. A companion bracket 159 extends upwardly from the skid assembly, and it supports a pillow block 161. A pair of suitable rigid links 163 extend between each pillow block 157, 161 on opposite sides thereof between the bearing shafts 157B, 161B to suspend the plate 42 above the skid, but the center of gravity is below the tops of skid brackets 159. This mounting configuration prevents the plate 42 from bouncing up and down, while allowing the plate to move back and forth.

The motor driven vibrator apparatus, generally designated by the reference numeral 138, is provided to vigorously vibrate plate 42 via the linkage 130. It consists of a motor driven, eccentric-equipped shaft. Alternatively conventional pneumatic or hydraulic vibrators could be substituted.

A plurality of vertical legs 92–95 (FIG. 3) extend upwardly from the lower skid to support appropriate transverse water feeders 100 and 101 over the ramp. These feeders are conventionally provided with an external source of clean feed water so as to establish a continual gravity-fed downward flow of water upon the belt 52. This flow eventually contacts the remnants of slurry 82 which has been separated upon the belt.

As best viewed in FIG. 8, feeders 100 and 101 are generally rectangular, and disposed immediately adjacent one another. Their support legs 92–95 are isolated from the ramp, so that vibrations transmitted to the ramp via plate 42 do not shake the water feeders. Separate hoses 104 and 105 are employed with valves for controlled feeding of water, and streams 110 of water will be noted. Spray bar 119 located in hopper 60 provides a stream of water 123 to cause a sheeting action, and removed fines recovered off the belt surface join concentrated fines 116 within hopper 60. The accumulated fines 116 can thereafter be drained via pipe 103 for further processing.

Thus as water moves down the ramp over the grooved surface of the rotatable belt it will eventually join the stream established by processing of the incoming slurry 82. As the classified material is initially deposited on the angled, reception region 68 of the belt, the lighter material bounces across the grooves 64 and drops straight off the lower ramp end. Heavier particles are caught in the grooves and rolled down them, the water lifting the lighter particles and carrying them to the end of the belt. This rolling action helps free lighter particles which may be trapped under layers of heavier materials. The heavier particles move across the belt to the conveying region 69 into calmer water and are carried up the belt, trapped in the groove portions 64B. As upward belt movement progresses the sheet of clean water continues to lift remaining lighter particles from the grooves and carry them away.

The clean water meeting the slurry provides sufficient weight of water to make all of the aforementioned take place. In the best mode the ramp uses on the order of approximately 500 gallons of water per minute. The divider plate 77 restrains the slurry to the reception region 68 (i.e. angled grooves) section of the belt until the above actions take place. In the lower regions of the ramp, the water flow will tend to move lighter particles out of the aggregate slurry. Heavier particles will tend to be trapped in the conveying grooves and carried to the uppermost end 48. As agitation occurs, the gold particles will tend to move toward the "flat" groove portions 64B, in which they will be entrained for conveyance to the upper end 48 of the ramp.

The output of the ramp system is constrained within hopper 60, and may be transmitted through hose 103 for subsequent processing. Also, belt cleansing provided by streams 110 and sprayer 119 will tend to clean the belt and extract the heavier concentrated fines into the hopper 60. In the best mode fines 116 should be further purified via conventional laboratory processing.

Extensive testing was done with the machine on the Liard River in the Yukon Territory in late summer of 1987. Consistently the recovery rate was above 95%, and in some instances approximated 99%. Gold particle size, both available and recovered, ranged from twenty to about 250 microns. Twice during the testing program, simultaneous samples were taken of raw bank gravels, tailings, and concentrate and were sent to the laboratory at the University of Saskatchewan in Saskatoon for analysis. In both instances, the results were confirmed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A fine separation machine for recovering heavy metal ores such as gold or the like from a previously de-rocked, mineral-bearing slurry, the separation machine comprising:

an inclined ramp comprising an elevated upper end, a lower end spaced apart from said upper end, a continuous belt entrained for rotation about said ramp between said lower and upper ends thereof;

means for rotating said belt;

said belt comprising a plurality of similar, generally parallel and regularly spaced-apart, cooperating grooves, each of said grooves comprising first portions oriented at an acute angle relative to the direction of travel of said belt and second portions interconnected with said first portions but oriented substantially perpendicularly with respect to the direction of travel of said belt;

a divider plate oriented substantially perpendicular with respect to said ramp and generally dividing and separating said first portions of said grooves from said second portions of said grooves to respectively define feed and recovery belt regions;

means for delivering said slurry to said machine by applying it to said belt within said feed region established by said grooves; and, whereby unwanted materials including sands and water move down said belt means for discharge at the lower end of said ramp means, and concentrated gold-bearing fines are concurrently deflected to said recovery region of said belt for recovery.

2. The ore recovery machine as defined in claim 1 including a separate source of fresh water near said ramp upper end establishing a flow of water down said ramp so that water continually flows down said belt notwithstanding belt rotation.

3. The ore recovery machine as defined in claim 2 including:

a hopper for recovering concentrated fines, said hopper disposed beneath the upper end of said ramp; and, a spray system for washing said belt proximate said hopper to remove ore fines from said belt and recover them in said hopper.

4. The ore recovery machine as defined in claim 3 including a shaker system for vibrating said ramp to aid in the separation and purification of fines.

5. The ore recovery machine as defined in claim 3 including:

an elongated, rigid, supportive skid adapted to be disposed upon a supporting surface such as a suitably configured flat spot on the ground or the like;

a frame for mounting said ramp, said frame coupled to said skid with bearings to permit vibrations;

couplings securing said ramp to said frame so as to define a generally acute angle between said ramp and said frame, said couplings permitting adjustments to the height of said ramp to facilitate variations in said acute angle; and, a shaker for vibrating said frame and thus said ramp and belt during machine operation.

6. The ore recovery machine as defined in claim 1 wherein said means for delivering said slurry comprises spreader plate means for evenly distributing incoming slurry to be processed upon said belt.

7. The ore recovery machine as defined in claim 6 including:

a separate source of fresh water near said ramp upper end establishing a flow of water down said ramp so that water continually flows down said belt notwithstanding belt rotation;

a hopper for recovering concentrated fines, said hopper disposed adjacent the upper end of said ramp;

means for washing said belt to remove ore fines from said belt and recover them in said hopper; and, a shaker system for vibrating said ramp to aid in the separation and purification of fines.

8. The ore recovery machine as defined in claim 7 including:

an elongated, rigid, supportive skid adapted to be disposed upon a supporting surface such as a suitably configured flat spot on the ground or the like;

a frame for mounting said ramp, said frame coupled to said skid with bearings to permit vibrations;

couplings securing said ramp to said frame so as to define a generally acute angle between said ramp and said frame, said couplings permitting adjustments to the height of said ramp to facilitate variations in said acute angle; and, a shaker for vibrating said frame and thus said ramp and belt during machine operation.

9. The ore recovery machine as defined in claim 8 wherein said bearings are configured to permit horizontal vibrations to said ramp but to prohibit up and down vibrations.

10. An ore recovery machine for processing mineral bearing deposits of sand or the like to recover heavy metal ores such as gold, the machine comprising:

trough means for continually receiving a previously de-rocked slurry comprised of water and mineral bearing fines to be processed;

inclined ramp means for receiving fines from said trough means and for thereafter processing same, said ramp means comprising an elevated upper end, a lower end spaced apart from said upper end, belt means entrained for rotation over said ramp means and extending between said upper and lower ends, and motor means for rotating said belt means;

said belt means having an outer, exposed operational surface moving from the lower end of said ramp means to the upper end during belt means rotation, said belt means operative surface comprising a plurality of generally parallel and regularly spaced apart grooves, each of said grooves comprising:

a first portion oriented at a substantially acute angle relative to the direction of travel of said belt means, the first groove portions collectively defining a feed portion of said operational belt surface; and a second portion interconnected with said first portion but oriented substantially perpendicularly with respect to the direction of travel of said belt means, portion, the second groove portions collectively defining a recovery portion of said operational belt surface;

divider plate means extending from said trough means down said ramp means a substantial portion of the length of said ramp means for limiting initial input of said fines to said feed portion of said operational belt surface, said baffle means oriented substantially perpendicular with respect to said ramp means and generally dividing and separating said feed portion of said belt means from said recovery portion thereof;

means for applying fresh water near said ramp means upper end above said trough means so that water continually flows down said operational belt surface notwithstanding belt means rotation; and, whereby unwanted materials including sands and water move down said belt means for discharge at the lower end of said ramp means, and concentrated gold-bearing fines are concurrently deflected to said recovery portion of said belt surface for conveyance to said upper end of said ramp means for recovery.

11. The ore recovery machine as defined in claim 10 including:

hopper means for recovering concentrated fines, said hopper means disposed beneath the upper end of said ramp means; and, means for spraying said belt means proximate said hopper means to remove ore from said belt thereby cleaning same.

12. The ore recovery machine as defined in claim 11 including shaker means for vibrating said ramp means to aid in the separation and purification of fines.

13. The machine as defined in claim 10 including:

elongated, rigid skid means adapted to be disposed upon a supporting surface such as an appropriate spot on the ground or the like;

frame means for mounting said ramp means, said frame means coupled to said skid means with bearing means to permit vibrations;

means for coupling said ramp means to said frame means so as to define a generally acute angle between said ramp means and said frame means, said coupling means permitting adjustments to the height of said ramp means to facilitate variations in said acute angle; and, shaker means for vibrating said frame means and thus said ramp means during machine operation.

14. The ore recovery machine as defined in claim 13 wherein said bearings are configured to permit horizontal vibrations to said ramp but to prohibit up and down vibrations.

15. A gold recovery machine for processing sands bearing fine gold deposits to recover gold, the machine comprising:

means for continually receiving a previously derocked slurry comprised of water and gold-bearing fines to be processed;

inclined ramp means for receiving fines from said last mentioned means and for thereafter processing same, said ramp means comprising an elevated upper end, a lower end spaced apart from said upper end, belt means entrained for rotation over said ramp means and extending between said upper and lower ends, and means for rotating said belt means;

said belt means having an outer, exposed operational surface moving from the lower end of said ramp means to the upper end during belt means rotation, said belt means operative surface comprising a plurality of generally parallel and regularly spaced apart grooves, each of said grooves comprising:

a first portion oriented at a first angle relative to the direction of travel of said belt means, the first groove portions collectively defining a feed portion of said operational belt surface; and a second portion interconnected with said first portion but oriented at a second angle with respect to the direction of travel of said belt means, portion, the second groove portions collectively defining a recovery portion of said operational belt surface;

divider plate means extending from said trough means down said ramp means a substantial portion of the length of said ramp means for limiting initial input of said fines to said feed portion of said operational belt surface, said divider plate means oriented substantially perpendicular with respect to said ramp means and generally dividing and separating said feed portion of said belt means from said recovery portion thereof;

means for applying fresh water near said ramp means upper end above said trough means so that water continually flows down said operational belt surface notwithstanding belt means rotation;

whereby unwanted materials including sands and water move down said belt means for discharge at the lower end of said ramp means, and concentrated gold-bearing fines are concurrently deflected to said recovery portion of said belt surface for conveyance to said upper end of said ramp means; and, hopper means for recovering concentrated gold, said hopper means disposed adjacent the upper end of said ramp means; and, shaker means for vibrating said ramp means to aid in the separation and purification of gold fines.

16. The machine as defined in claim 15 including means for spraying said belt means proximate said hopper means to remove gold ore from said belt thereby cleaning same.

17. The machine as defined in claim 16 including:

elongated, rigid skid means adapted to be disposed upon a supporting surface such as an appropriate spot on the ground or the like;

frame means for mounting said ramp means, said frame means coupled to said skid means with bearing means to permit vibrations;

means for coupling said ramp means to said frame means so as to define a generally acute angle between said ramp means and said frame means, said coupling means permitting adjustments to the height of said ramp means to facilitate variations in said acute angle; and, shaker means for vibrating said frame means and thus said ramp means during machine operation.

18. The ore recovery machine as defined in claim 17 wherein said bearings are configured to permit horizontal vibrations to said ramp means but to prohibit up and down vibrations.

* * * * *